US007612760B2

(12) United States Patent
Kawai

(10) Patent No.: US 7,612,760 B2
(45) Date of Patent: Nov. 3, 2009

(54) ELECTROPHORESIS DEVICE, METHOD OF DRIVING ELECTROPHORESIS DEVICE, AND ELECTRONIC APPARATUS

(75) Inventor: Hideyuki Kawai, Fujimi-machi (JP)

(73) Assignees: Seiko Epson Corporation, Tokyo (JP); E Ink Corporation, Cambridge, MA (US)

( * ) Notice: Subject to any disclaimer, the term of this patent is extended or adjusted under 35 U.S.C. 154(b) by 635 days.

(21) Appl. No.: 11/319,394

(22) Filed: Dec. 29, 2005

(65) Prior Publication Data

US 2006/0181504 A1 Aug. 17, 2006

(30) Foreign Application Priority Data

Feb. 17, 2005 (JP) ..... 2005-040229

(51) Int. Cl.
*G09G 3/34* (2006.01)

(52) U.S. Cl. ..... 345/107; 345/204

(58) Field of Classification Search ..... 345/84–107, 345/204, 210; 359/245, 249, 269, 296
See application file for complete search history.

(56) References Cited

U.S. PATENT DOCUMENTS 6,738,039 B2 * 5/2004 Goden ..... 345/107
2002/0033792 A1 3/2002 Inoue
2002/0036616 A1 * 3/2002 Inoue ..... 345/107
2003/0058521 A1 * 3/2003 Kawai ..... 359/296
2003/0067666 A1 * 4/2003 Kawai ..... 359/296
2003/0222315 A1 * 12/2003 Amundson et al. ..... 257/368
2004/0017349 A1 * 1/2004 Kawai ..... 345/107

FOREIGN PATENT DOCUMENTS

JP A 2002-149115 5/2002

* cited by examiner

*Primary Examiner*—Amare Mengistu
*Assistant Examiner*—Hong Zhou
(74) *Attorney, Agent, or Firm*—Oliff & Berridge, PLC

(57) ABSTRACT

An electrophoresis device includes a pair of substrates, a plurality of pixel electrodes, and a common electrode formed on the pair of substrates, a liquid material formed by dispersing charged particles sealed between the pair of substrates and a driving circuit for applying a voltage to the pixel electrodes and the common electrode to generate an electric field therebetween. When display image is changed, the driving circuit generates a first electric field between all the pixel electrodes and the common electrode to delete the image displayed by that time over the entire display region. Then, when new display image is written, the driving circuit generates a second electric field between the pixel electrodes corresponding to display and the common electrode, and generates a third electric field between the common electrode and the pixel electrodes not corresponding to display.

8 Claims, 10 Drawing Sheets

ELECTROPHORESIS DEVICE, METHOD OF DRIVING ELECTROPHORESIS DEVICE, AND ELECTRONIC APPARATUS

BACKGROUND OF THE INVENTION

1. Field of the Invention

The present invention relates to an electrophoresis device using an electrophoresis phenomenon, a method of driving the electrophoresis device, and an electronic apparatus including the electrophoresis device.

Priority is claimed on Japanese Patent Application No. 2005-040229, filed Feb. 17, 2005, the image of which is incorporated herein by reference.

2. Description of Related Art

As an electrophoresis phenomenon, a phenomenon in which charged particles dispersed in a liquid are migrated by an electric field has been generally known. As a technology for applying this phenomenon, there has been known a technology that, when an electric field is applied between a pair of electrodes in a state in which one formed by dispersing charged pigment micro particles into a dispersion colored with a dye is inserted between the pair of electrodes, the charged particles are attracted by any one of the electrodes. Efforts for implementing a display device by using the phenomenon have conventionally been made. A material formed by dispersing the charged particles into the dispersion colored with the dye is called electro phoretic ink, and a display device using the electro phoretic ink is called an electro phoretic display (EPD).

When the electric field is applied to the electro phoretic ink from the outside, the charged particles move in a direction of the electric field in the case where the charged particles are charged with the positive polarity, and the charged particles move in a direction opposite to the direction of the electric field in the case where the charged particles are charged with a negative polarity. As a result, the side from which the electro phoretic ink is seen, that is, a display surface is seen like being colored with any of the color of a solvent and the color of the charged particle. Therefore, the movement of the charged particles of the electro phoretic ink that is located on each pixel surface is controlled for every pixel, so that display information can be displayed on the display surface.

In recent years, there has been suggested a technology that the electro phoretic ink is filled into the microcapsule to constitute the electro phoretic ink in a microcapsule manner, thereby improving the reliability of display. Two kinds of charged particles composed of a charged particle having a color forming display and a charged particle having a color forming a background are filled into the microcapsule. In other words, the electro phoretic ink made in the microcapsule manner is coated on an active matrix type of element array to achieve a display device (electrophoresis device) with excellent visibility and low power consumption.

However, the electrophoresis device formed by combining the electro phoretic ink constructed in the microcapsule manner and the active matrix type of element array has problems of a driving method as follows.

The voltage (a difference in electric potential) required when the displayed image is changed depends on the size of the microcapsule (diameter) and has approximately 1 V/μm. The diameter of a general microcapsule is several tens μm, so that the voltage needs at least 10 V. Here, it is described the case in which the driving voltage is set to 10 V and a typical method of driving a liquid crystal display is applied to the electrophoresis device.

First, the voltage applied to the common electrode is set to 10 V, and the voltage applied to the pixel electrode is set to 0 V or 20 V. In other words, when the electric potential of the common electrode is greater than that of the pixel electrode, the voltage applied to the pixel electrode is set to 0 V. To the contrary, when the electric potential of the pixel electrode is greater than that of the common electrode, the voltage applied to the pixel electrode is set to 20 V. Therefore, the displayed image can be rewritten.

However, for the voltage applied to the pixel electrode, the driving voltage is too high when switching the TFT connected to the pixel electrode, so that it is difficult to obtain the reliability of the TFT. In addition, a voltage of 20 V is only an approximate value, and the voltage may be 30 V or more. In this case, it is further difficult to obtain reliability.

In addition, as another typical method of driving the liquid crystal display, a method that the electric potential of the common electrode is changed is known, which is called a common swing method. In other words, when the electric potential of the common electrode is greater than that of the pixel electrode, the voltage applied to the pixel electrode is set to 0 V, and the voltage applied to the common electrode is set to 10 V. To the contrary, when the electric potential of the pixel electrode is greater than that of the common electrode, the voltage applied to the pixel electrode is set to 10 V, and the voltage applied to the common electrode is set to 0 V. As a result, the displayed image can be rewritten at a voltage of 10 V, and the reliability of the TFT can be improved.

However, this method has the following problems.

For example, it is assumed that the voltages of 10 V and 0 V are respectively applied to the common electrode and the pixel electrode in order to rewrite the displayed image of any pixel. In this case, the voltage of 10 V must be applied to the other pixel electrodes to which the displayed image is not rewritten, in order to prevent an erroneous rewriting operation. However, since applying the voltage to each pixel electrode is performed by sequentially selecting each pixel transistor, the timing when applying the voltage to each pixel electrode does not coincide with the timing when applying the voltage to the common electrode, so that delay occurs. As a result, there is a fear that the erroneous rewriting occurs. In addition, even though the voltage is applied to each pixel electrode before the erroneous rewriting occurs, the voltage of the pixel electrode gradually decreases due to the leakage of the pixel transistor. There is a possibility that the erroneous rewriting will occur.

Therefore, as a conventional art for solving these problems, there is provided a display device (electrophoresis device) in which, when the displayed image is changed, the image displayed by that time is deleted over the entire display region and new display image is written on the display region (for example, see Japanese Unexamined Patent Application Publication No. 2002-149115).

In other words, all the plurality of pixel electrodes is set to have the same electric potential, the voltage is applied between the common electrode and the pixel electrode, and the image displayed by that time is deleted over the entire display region. After that, when the new display image is rewritten on the display region, the electric potential of the common electrode is the same as that of the pixel electrode, and a predetermined electric potential is applied to the pixel electrode to be rewritten.

By driving in this manner, it is possible to prevent erroneous rewriting as described above.

However, the above-mentioned conventional display device (electrophoresis device) has the following problems.

FIGS. 13A and 13B are diagrams for illustrating the problems of the display device, where reference numeral 1 indicates a plurality of pixel electrodes provided on a first substrate (not shown) and reference numeral 2 indicates a common electrode provided on a second substrate (not shown). A liquid material (not shown) containing black particles 3 and white particles 4 is sealed between the pixel electrodes 1 and the common electrode 2 so as to be interposed therebetween. The black particles 3 are colored with black, functioning as a display color, and are charged with a positive polarity, and the white particles 4 are colored with white, functioning as a background color, and are charged with a negative polarity. In the display device (electrophoresis device), the common electrode 2 forms the display surface. In addition, the liquid material is commonly used with the microcapsule type. However, in this case, the description of the microcapsule is omitted for the simplicity of description.

In the above-mentioned display device, when the displayed image is changed, the image displayed by that time is deleted over the entire display region (image deleting), as shown in FIG. 13A.

In other words, all pixel electrodes 1 have the same electric potential (Vss), and a different voltage is applied to the common electrode 2 to have an electric potential (Vdd) (however, Vdd>Vss). As a result, an electric field (indicated by an arrow in FIG. 13A) from the common electrode 2 toward the pixel electrode 1 is generated between the pixel electrode 1 and the common electrode 2, the white particles 4 charged with the negative polarity move (migrate) toward the common electrode 2 by the electric field, and the black particles 3 charged with the positive polarity move (migrate) toward the pixel electrode 1. By driving in this manner, since the common electrode 2, functioning as the display surface, forms the background color by the white particles 4, the previous displayed image is deleted.

After that, new display image is rewritten on the display region (new image writing), as shown in FIG. 13B.

In other words, a voltage is selectively applied to the pixel electrodes 1*a* corresponding to display to make the electric potentials of the pixel electrodes changed to the electric potential (Vdd), and a different voltage is applied to the common electrode 2 to make the electric potential of the common electrode changed to the electric potential (Vss). As a result, a direction of the electric field is reversed only on the pixel electrodes 1*a* corresponding to display, so that the black particles 3 move toward the common electrode 2, and the white particles 4 move toward the pixel electrode 1*a*. On the other hand, in the pixel electrode 1*b* which is not corresponding to display and forms the background as it is, the common electrode 2 and the pixel electrode 1*b* become the same electric potential (Vss). Therefore, the particles 3 and 4 are held at locations at the time when deleting the image as they are, without the movement of the particles due to the removal of the electric field.

However, since the switching element or wiring line is generally connected to the pixel electrode 1 (1*a* and 1*b*), the pixel electrode is subjected to a voltage drop due to the channel resistance or wiring resistance and the influence of the wiring capacity or the like. As a result, the electric potential of the pixel electrode 1 (1*a* and 1*b*) becomes Vss', not Vss, even though the voltage is applied thereto such that the pixel electrode has the Vss, as shown in FIGS. 14A and 14B. In other words, the Vss' is a little larger than Vss.

If so, there is no problem when the image is deleted as shown in FIG. 14A. But, the electric potential difference between the electric potential (Vss) in the common electrode 2 and the electric potential (Vss') in the pixel electrode 1*b* occurs in the pixel electrode 1*b* which forms the background when the new image is written as shown in FIG. 14B, so that a weak electric field from the pixel electrode 1 toward the common electrode 2 is generated. As a result, the particles 3 and 4 move a little from the locations at the time when deleting the image and a gray color is displayed at the portions on which the white color, functioning as the background color, must be originally displayed, thereby deteriorating contrast and image quality.

SUMMARY OF THE INVENTION

Accordingly, the present invention is designed to solve the above-mentioned problems, and it is an object of the present invention to provide an electrophoresis device, a method of driving the electrophoresis device, and an electronic apparatus including the electrophoresis device, capable of preventing the deterioration of contrast and of improving image quality.

In order to achieve the above-mentioned object, the present invention provides an electrophoresis device including a pair of substrates, a plurality of pixel electrodes and a common electrode formed on the pair of substrates, a liquid material formed by dispersing charged particles sealed between the pair of substrates, and a driving circuit for applying a voltage to the pixel electrodes and the common electrode to generate an electric field therebetween, the electrophoresis device performing display by moving the charged particles using the electric field generated by applying the voltage, wherein, when display image is changed, the driving circuit makes all the pixel electrodes have a first electric potential, makes the common electrode have a second electric potential, generates a first electric field between all of the pixel electrodes and the common electrode, and makes the image displayed by that time deleted over the entire display region. Then, when new display image is written, the driving circuit makes the electric field of the common electrode changed to a third electric field, makes the electric potentials of the pixel electrodes corresponding to display changed to a fourth electric potential, makes the electric potentials of the pixel electrodes not corresponding to the display changed to a fifth electric potential, generates a second electric field between the common electrode and the pixel electrodes corresponding to the display and generates a third electric field between the common electrode and the pixel electrodes not corresponding to the display. A direction of the first electric field is opposite to that of the second electric field, the direction of the first electric field is the same as that of the third electric field, and the intensity of the second electric field is greater than that of the third electric field.

According to the electrophoresis device, when the displayed image is changed, the image displayed by that time is deleted over the entire display region, and the new image is written, as in the conventional art. Furthermore, when the new display image is written, the electric potentials of the pixel electrodes corresponding to display are changed to the fourth electric potential, and the electric potential of the common electrode is changed to the third electric potential.

Specifically, the first electric potential is the electric potential (Vss') shown in FIGS. 14A and 14B. In other words, the first electric potential mentioned in the present invention means not the application voltage when the being applied from the driving circuit to the pixel electrode 1 (1*a* and 1*b*) but the electric potential (Vss') at the pixel electrode after the pixel electrode is subjected to a voltage drop due to the channel resistance or wiring resistance and the influence of the wiring capacity or the like. In addition, the electric potential (Vss') is considered as an electric potential that is a little changed between the pixel electrodes. In this case, a maximum value rather than the average value of the pixel electrodes is defined as the first electric potential (Vss') in the present invention.

In addition, the second electric potential is the electric potential (Vdd) shown in FIG. 14A. The first electric potential is applied to all the pixel electrodes 1, and the second electric potential is applied to the common electrode 2, so that the first electric field from the common electrode 2 toward the pixel electrode 1 is generated as shown in FIG. 14A. According to the present invention, when the new display image is written, the electric potential of the common electrode 2 becomes the third electric potential (Vbias), not the electric potential (Vss) as in the conventional art, the electric potentials of the pixel electrodes corresponding to display are changed to the fourth electric potential (i.e., Vdd), the electric potentials of the pixel electrodes not corresponding to display are changed to the fifth electric potential (i.e., Vss'). As a result, the second electric field is generated between the common electrode and the pixel electrodes corresponding to display, and the third electric field is generated between the common electrode and the pixel electrodes not corresponding to display. Here, the direction of the first electric field is opposite to that of the second electric field, and the direction of the first electric field is the same as that of the third electric field. As a result, in the pixel electrode which does not correspond to display and forms the background as it is, the electric field from the pixel electrode 1*b* toward the common electrode 2 shown in FIG. 14B is not generated. Therefore, it is possible to prevent the deterioration of contrast and image quality due to the electric field from the pixel electrode 1*b* toward the common electrode 2.

In addition, in the pixel electrode 1*a* corresponding to display, by the electric field, the particles move to the set electrode side to form a desired display, similar to FIG. 14B.

In addition, when all the electric potentials (i.e., Vbias, Vss', and Vdd) have a negative polarity, the charged polarities of the particles are changed in contrast to the example shown in FIGS. 14A and 14B, so that the same effect as the case in which all the electric potentials have a positive polarity may be obtained.

In the electrophoresis device, since the intensity of the second electric field is greater than that of the third electric field, display switching is relatively rapidly performed when a change from an image deleting mode to a new image writing mode is made. In other words, the speed of the display switching performed by the movement of the electrophoresis particles depends on the intensity of the second electric field. Therefore, since the intensity of the second electric field is greater than that of the third electric field at the side where the display switching is not performed, the display switching may be relatively rapidly performed as described above.

In the electrophoresis device, it is preferable that the relationship between the second electric field and the third electric field satisfy the following Formula 1:

$$\text{the intensity of the third electric field} \leqq (\text{the intensity of the second electric field})/10. \quad \text{[Formula 1]}$$

According to this aspect, the intensity of the second electric field is greater than that of the third electric field by ten times or more. Therefore, when the image deleting mode is changed to the new image writing mode, the display switching may be particularly rapidly performed, so that display characteristics may be improved.

In addition, it is preferable that the intensity of the third electric field be substantially zero. In this case, even though the intensity of the second electric field is relatively small, the intensity of the second electric field is sufficiently greater than that of the third electric field.

In the electrophoresis device, it is preferable that the liquid material in which the charged particles are dispersed be filled into a microcapsule.

According this aspect, it is possible to prevent a decrease in the reliability of the electro phoretic ink due to the condensation of the pigment micro particles functioning as the charged particles, and it is possible to increase the reliability of display.

In the electrophoresis device, it is preferable that the charged particles be composed of a first electrophoresis particle charged with a first polarity and having a first color (for example, a display color) and a second electrophoresis particle charged with a second polarity and having a second color (for example, a background color).

According to this aspect, it is not necessary to color a dispersion solution in which the charged particles are dispersed the background color. Therefore, it is possible to achieve a high-definition display.

In the electrophoresis device, it is preferable that the pair of substrates be composed of flexible substrates.

According to this aspect, since the electrophoresis device can be used as, for example, an electronic paper, the electrophoresis device has many uses.

Furthermore, the present invention provides a method of driving an electrophoresis device including a pair of substrates, a plurality of pixel electrodes and a common electrode respectively formed on the pair of substrates, a liquid material obtained by dispersing charged particles sealed between the pair of substrates, and a driving circuit for applying a voltage to the pixel electrodes and the common electrode to generate an electric field therebetween, the electrophoresis device performing display by moving the charged particles through the electric field generated by applying the voltage, the method including: making, when display image is changed, all the pixel electrodes have a first electric potential and making the common electrode have a second electric potential to generate a first electric field between all the pixel electrodes and the common electrode and thus to delete current image displayed over an entire display region; and changing, when new display image is written, the electric potentials of the common electrode into a third electric potential, changing the electric potentials of the pixel electrodes corresponding to display into a fourth electric potential, and of changing the electric potentials of the pixel electrodes not corresponding to the display into a fifth electric potential to generate a second electric field between the pixel electrodes corresponding to the display and the common electrode and to generate a third electric field between the common electrode and the pixel electrodes not corresponding to the display. When the electrophoresis device is driven by the driving circuit, the direction of the first electric field is opposite to that of the second electric field, the direction of the first electric field is the same as that of the third electric field, and the intensity of the second electric field is greater than that of the third electric field.

According to the method of driving the electrophoresis device, when new display image is written, the electric potential of the common electrode 2 has the third electric potential (Vbias), not the electric potential (Vss) as in the conventional art, similar to the above-mentioned electrophoresis device. Therefore, it is possible to prevent the deterioration of contrast and image quality due to the electric field from the pixel electrode 1*b* toward the common electrode 2.

Since the intensity of the second electric field is greater than that of the third electric field, display switching may be relatively rapidly performed when the image deleting mode is changed to the new image writing mode.

An electronic apparatus according to the present invention includes the electrophoresis device.

According to the electronic apparatus, since the electronic apparatus includes the electrophoresis device in which the deterioration of image quality may be prevented and display switching may be relatively rapidly performed when new image writing is performed, the reliability of a display unit using the electrophoresis device may increase.

DESCRIPTION OF THE PREFERED EMBODIMENTS

Hereinafter, the present invention will be described in detail with reference to the accompanying drawings.

First Embodiment

Figure 1:
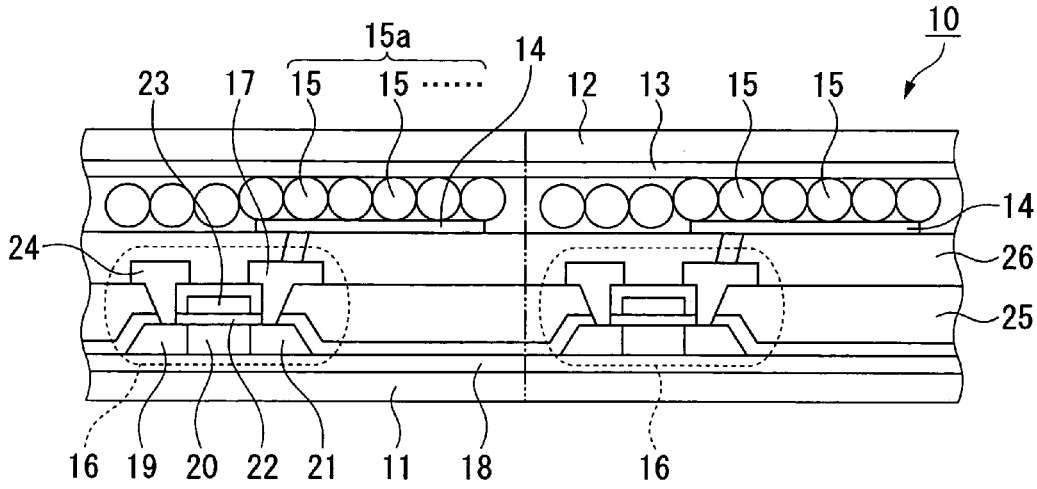
FIG. 1 is a side cross-sectional view of essential parts showing a schematic structure of an electrophoresis device according to a first embodiment of the present invention.

FIG. 1 shows an electrophoresis device according to a first embodiment of the present invention. In FIG. 1, reference numeral 10 indicates an electrophoresis device. The electrophoresis device 10 is formed by attaching a counter substrate 12 on a substrate 11. A common electrode 13 is provided at the inner side of the counter substrate 12, and a microcapsule layer 15*a* is provided between the common electrode 13 and pixel electrodes 14 formed on the substrate 11. The microcapsule layer 15*a* is composed of microcapsules 15 encapsulating electrophoresis particles therein.

A drain electrode 17 of a TFT (thin film transistor) 16 is connected in series to each pixel electrode 14, and the TFT 16 serves as a switching element.

In addition, in the electrophoresis device 10 having the above-mentioned structure, one of the substrate 11 and the counter substrate 12 serves as a display surface (an observation surface). In addition, the electrode and the substrate serving as the display surface need to have high transmissivity and are preferably transparent. In the present embodiment, the counter substrate 12 serves as the display surface, so that the counter substrate 12 and the common electrode 13 are made of a transparent material.

In addition, the substrate 11 and the counter substrate 13 use a resin substrate having a rectangular film shape or a rectangular sheet shape when a display device 1 needs to have flexibility like an IC card or an electronic paper.

Furthermore, as described above, the counter substrate 12 serving as the display surface (observation surface) is made of the above-mentioned transparent material (a material having high transmissivity). Specifically, polyethylene terephthalate (PET), polyether sulfone (PES), and polycarbonate (PC) are suitably used. Meanwhile, the substrate 11 not serving as the display surface does not need to be made of a transparent material (a material having high transmissivity). Therefore, polyester, such as polyethylenenaphthalate (PEN), polyethylene (PE), polystyrene (PS), polypropylene (PP), polyetheretherketone (PEEK), acryl or polyacrylates as well as the above-mentioned materials can be used.

Furthermore, when the electrophoresis device 10 does not need to have flexibility as in a general panel, each substrate can be made of glass, hard resin, or is composed of a semiconductor substrate made of silicon.

The TFT 16 includes a source layer 19, a channel 20, and a drain layer 21 which are formed on a base insulating film 18 on the substrate 11, a gate insulating film 22 formed on these components, a gate electrode 23 formed on the gate insulating film 22, a source electrode 24 formed on the source layer 19, and a drain electrode 17 formed on the drain layer 21. In addition, the TFT 16 is sequentially covered with an insulating film 25 and an insulating film 26.

The common electrode 13 is made of the above-mentioned transparent material (a material having high transmissivity). Specifically, the transparent material for forming the common electrode may be electrically conductive oxides, such as ITO (Indium Tin Oxide), electron conductive polymers, such as polyaniline, and ion conductive polymers obtained by dispersing ion materials, such as NaCl, LiClO4 and KCl, in a matrix resin, such as a polyvinylalcohol resin and a polycarbonate resin, and one or more materials among these materials are selectively used. On the other hand, since the substrate 11 on which the pixel electrodes 14 are formed does not serve as the display surface, the pixel electrode 14 does not need to be transparent (high transmissivity). Therefore, the material for forming the pixel electrode 14 can be a general conductive material, such as aluminum (Al). Of course, it is also possible to use the above-mentioned transparent materials.

Figure 2:
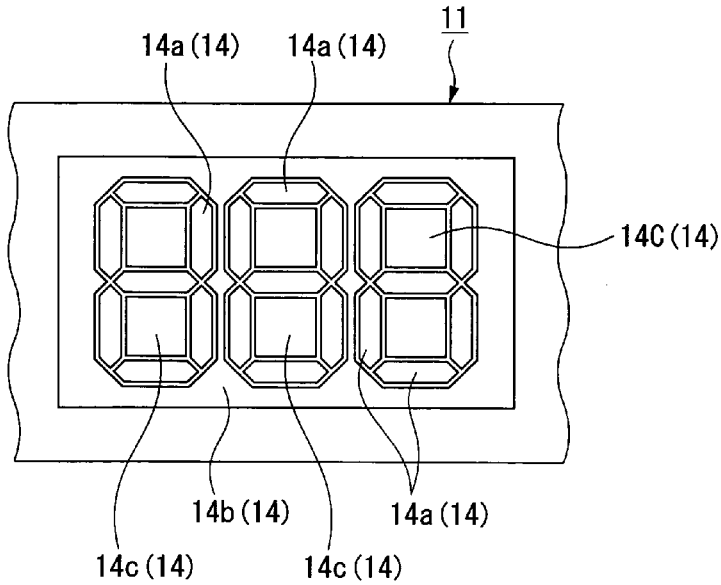
FIG. 2 is a plan view showing an inner surface of a substrate where pixel electrodes are provided.

Here, according to the present embodiment, the pixel electrode 14 is composed of segment electrodes. FIG. 2 is a plan view showing the inner side of the substrate 11. In the substrate 11, each pixel electrode 14 has seven segment electrodes 14*a* which are called seven segments and background electrodes 14*b* and 14*c* which form a background of the display by the segment electrodes 14*a*. The segment electrodes 14*a* are arranged in the shape of a FIG. 8 such that figures from 0 to 9 can be displayed. In the present embodiment, three sets of segment electrodes 14*a* are formed such that a three-digit figure can be displayed. In addition, the background electrodes 14*b* are arranged at the outside of the segment electrodes 14*a*, and the background electrodes 14*c* are arranged in an area surrounded by four segment electrodes 14*a* with respect to the segment electrodes 14*a* arranged so as to be formed according to the above-mentioned method. In addition, the background electrodes 14*b* and 14*c* may be formed such that they are connected to each other between the segment electrodes 14*a* and always have the same electric potential.

Figure 3A:
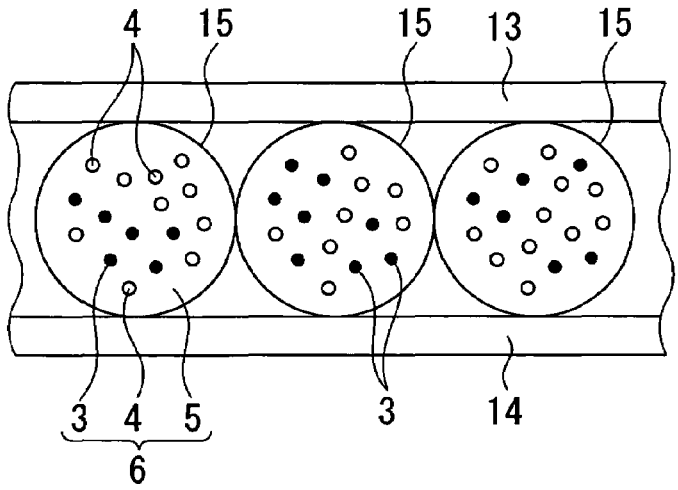
FIGS. 3A to 3C are explanatory views of a microcapsule and an electrophoresis particle.

In the electrophoresis device 10 according to the present embodiment, as shown in FIG. 1, the microcapsules 15 encapsulating the electrophoresis particles are bonded with a binder (not shown), so that the microcapsule layer 15*a* are formed between the substrate 11 and the counter substrate 12. As shown in FIG. 3A, an electrophoresis dispersion liquid (a liquid material) 6 composed of two kinds of electrophoresis particles 3 and 4 and a liquid dispersant 5 for dispersing the electrophoresis particles 3 and 4 is encapsulated in each microcapsule 15.

The liquid dispersant 5 may be water, alcohol-based solutions, such as methanol, ethanol, isopropanol, butanol, octanol, and Methyl cellosolve (2-methoxyethanol), various esters, such as ethyl acetate and butyl acetate, ketones, such as aceton, methyl ethyl ketone and methyl isobutyl ketone, aliphatic hydrocarbon such as pentane, hexane and octane, alicyclic hydrocarbon such as cyclohexane and metylcyclohexane, aromatic hydrocarbon such as benzenes having long chain alkyl group such as benzene, toluene, xylene, hexylbenzene, heptylbenzene, octylbenzene, nonylbenzen, decylbenzen, undecylbenzene, dodecylbenzene, tridecylbenzene and tetradecylbenzen, halogenated hydrocarbon such as methylene chloride, chloroform, carbon tetrachloride and 1,2-dichloroethane, and materials obtained by mixing surface active agents with carboxylate or each of various oils other than the carboxylate or a mixture of the various oils.

In addition, the electrophoresis particles 3 and 4 are organic or inorganic particles (polymer or colloid) having a property of moving by the electrophoresis caused by the electric potential difference in the liquid dispersant 5.

The electrophoresis particles 3 and 4 may be made of two kinds of materials selected from a black pigment such as aniline black, carbon black and titan black, a white pigment such as titanium dioxide, zinc oxide and antimony trioxide, a yellow pigment such as isoindolinone, chrome yellow, yellow iron oxide, cadmium yellow, titan yellow and antimony, an azo-based pigment such as monoazo, disazo and polyazo, a red pigment such as quinacridonelate and chromevermilion, a blue pigment such as phthalocyanine blue, induslene blue, an anthraquinone-based pigment, iron blue, ultramarine blue and cobalt blue, a green pigment such as phthalocyanine green.

Furthermore, if necessary, to these pigments, a charge control agent made of particles, such as an electrolyte, a surface active agent, a metallic soap, a resin, rubber, oil, a varnish and a compound, a dispersing agent such as a titanium-based coupling agent, an aluminum-based coupling agent and a silane-based coupling agent, a lubricant agent and a stabilizing agent may be added.

In addition, the specific gravities of the electrophoresis particles 3 and 4 are set to be substantially equal to that of the liquid dispersant 5 for dispersing the electrophoresis particles.

Furthermore, a material for forming a wall film of the microcapsule 15 may be a compound, such as a composite film of gum Arabic and gelatinum, a urethane resin, and a urea resin.

According to the present embodiment, one of the two kinds of electrophoresis particles 3 and 4 is charged with a positive polarity, and the other of the two kinds of electrophoresis particles 3 and 4 is charged with a negative polarity. In addition, of the two kinds of electrophoresis particles 3 and 4, the electrophoresis particles 3 function as black particles that form a figure, and the electrophoresis particles 4 function as white particles that form the background. According to the present embodiment, the black particles 3 are formed of a carbon black functioning as the black pigment and are charged with the positive electrode. In addition, the white particles 4 are formed of a titanium dioxide functioning as the white pigment and are negatively charged.

In addition, in the microcapsule layer 15*a*, as the binder for fixing the microcapsule 15 therein, a material having an excellent affinity for the wall film of the microcapsule 15, excellent adhesion to the base, and an insulating property may be used. For example, the materials for forming the binder may be a thermoplastic resin such as polyethylene, chlorinated polyethylene, ethylene-vinyl acetate copolymer, ethylene-ethyl acrylate copolymer, polypropylene, ABS resin, resin of methyl methacrylate, vinyl chloride resin, vinyl chloride-vinyl acetate copolymer, vinyl chloride-vinylidene chloride copolymer, vinyl chloride-acrylate copolymer, vinyl chloride-methacrylate copolymer, vinyl chloride-acrylonitrile copolymer, ethylene-vinyl alcohol-vinyl chloride copolymer, propylene-vinyl chloride copolymer, vinylidene chloride resin, polyvinyl acetate resin, polyvinyl alcohol, polyvinyl formal and a cellulose resin, a polymer such as polyamide resin, polyacetal, polycarbonate, polyethylene terephthalate, polybutylene terephthalate, polyphenylene oxide, polysulfone, polyamide imide, polyaminobismaleimide, polyethersulfone, polyphenylenesulfone, polyalylate, grafted polyphenlyene eter, polyether ethyl ketone and polyetherimide, a fluororesin such as polytetrafluoroethylene, polyethylene propylene fluoride, polytetrafluoroethylene-perfluoroalkoxyethylen copolymer, ethylene-tetrafluoroethylene copolymer, polyvinylidene fluoride, polyethylene chloride trifluoride and fluororubber, silicone resin such as silicone rubber, methacrylate-styrene copolymer, polybutylene and methyl methacrylate-butadiene styrene copolymer.

In the microcapsule having the above-mentioned structure, when the electric field is applied to the microcapsule from the outside, the electrophoresis particles 3 and 4 (black particles and white particles) in the microcapsule move in the direction of the electric field according to the charged polarity.

Figure 3B:
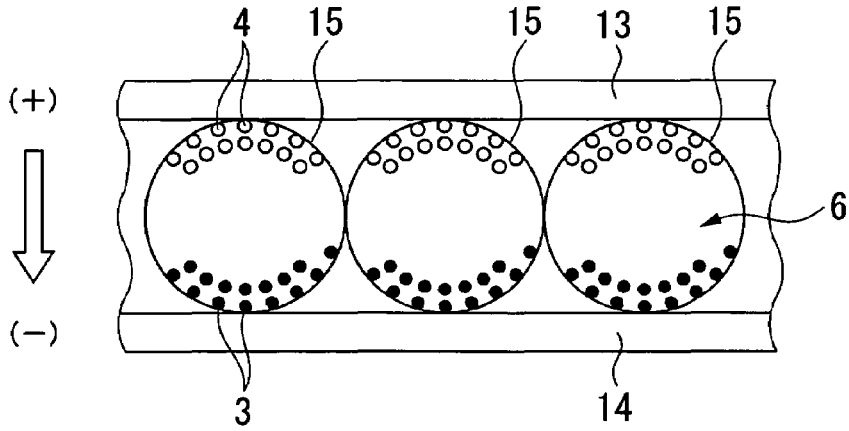
Figure 13A:
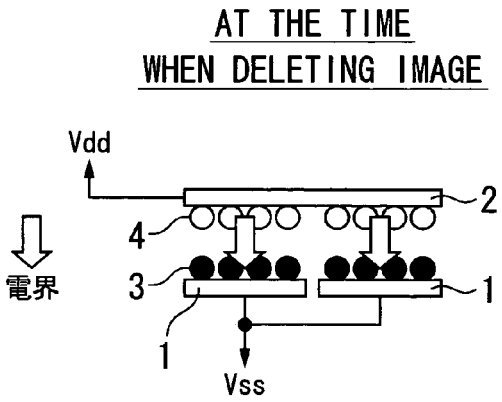
FIGS. 13A and 13B are diagrams for illustrating a problem of a conventional electrophoresis device.

For example, when the electric potential of the common electrode 13 is high and the electric potential of the pixel electrode 14 is low, an electric field (indicated by an arrow in FIG. 13A) from the common electrode 13 toward the pixel electrode 14 is generated between the common electrode 13 and the pixel electrode 14, as shown in FIG. 3B. Then, by the generated electric field, the white particles 4 charged with the negative polarity move (migrate) toward the common electrode 13, and the black particles 3 charged with the positive polarity move (migrate) toward the pixel electrode 14. Then, since the common electrode 13 functioning as the display surface forms the background color by the white particles 4, only the background color, not the actual display, is displayed on the counter substrate 12 functioning as the display surface.

Figure 3C:
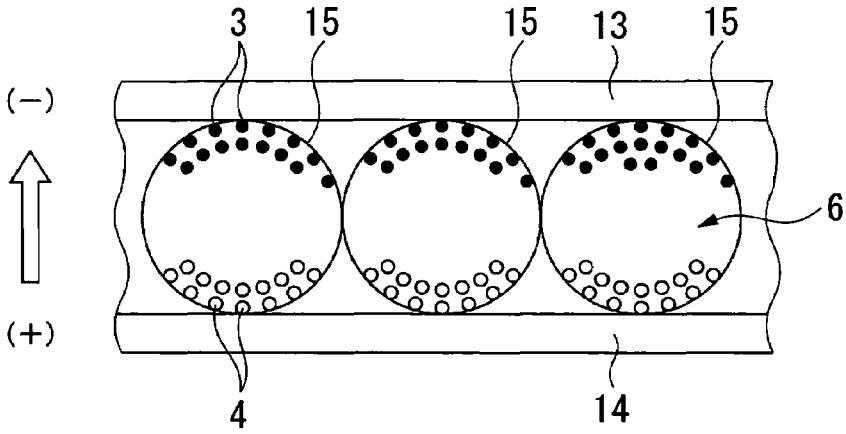

In addition, when the electric potential of the common electrode 13 is low and the electric potential of the pixel electrode 14 is high, an electric field (indicated by an arrow in FIG. 13A) from the pixel electrode 14 toward the common electrode 13 is generated between the common electrode 13 and the pixel electrode 14, as shown in FIG. 3C. Then, by the generated electric field, the white particles 4 charged with the negative polarity move (migrate) toward the pixel electrode 14, and the black particles 3 charged with the positive polarity move (migrate) toward the common electrode 13. Then, since the common electrode 13 functioning as the display surface forms the display color by the black particles 3, the black display is performed on the entire counter substrate 12 functioning as the display surface.

In addition, a driving circuit is connected to the pixel electrode 14 and the common electrode 13 for applying a voltage to these electrodes to move the electrophoresis particles 3 and 4 (black and white particles), thereby performing display.

Figure 4A:
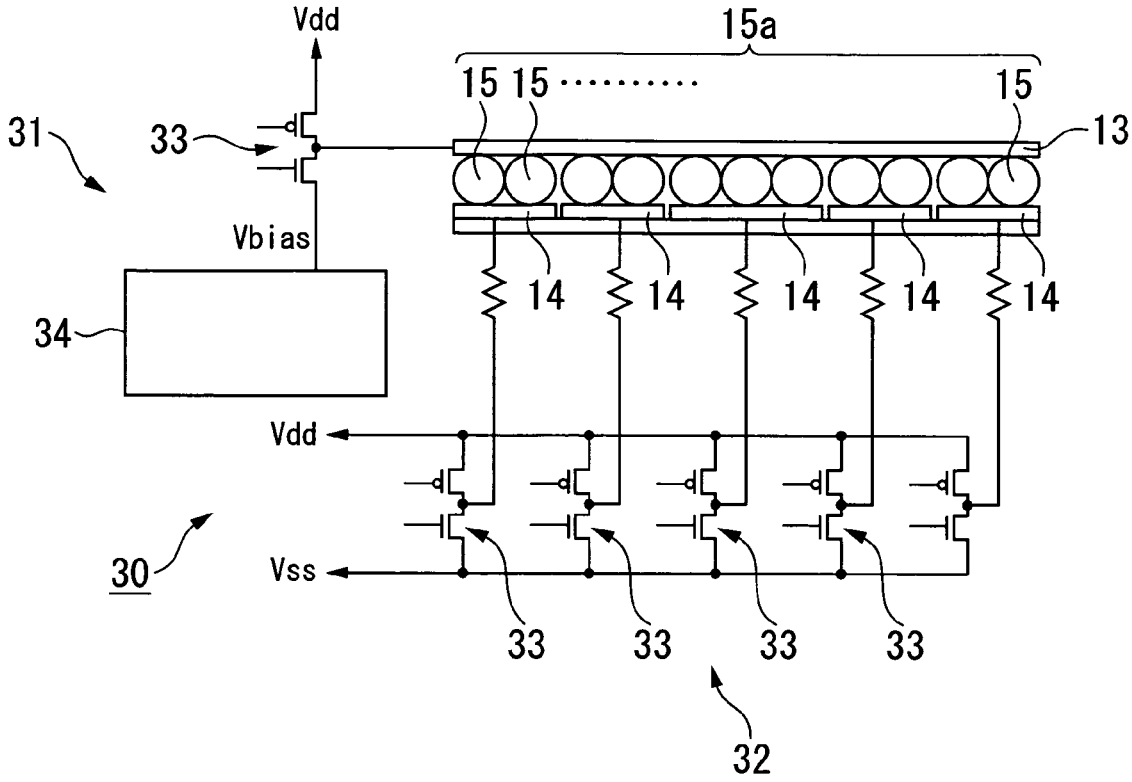
FIGS. 4A and 4B are explanatory views of a driving circuit.

FIG. 4A is a diagram for illustrating the driving circuit. In FIG. 4A, reference numeral 30 indicates the driving circuit. The driving circuit 30 includes a common electrode side circuit 31 connected to the common electrode 13 and a pixel electrode side circuit 32 connected to the pixel electrodes 14. The common electrode side circuit 31 and the pixel electrode side circuit 32 are respectively formed of three-state buffer circuits 33 as the main constituent elements.

Figure 4B:
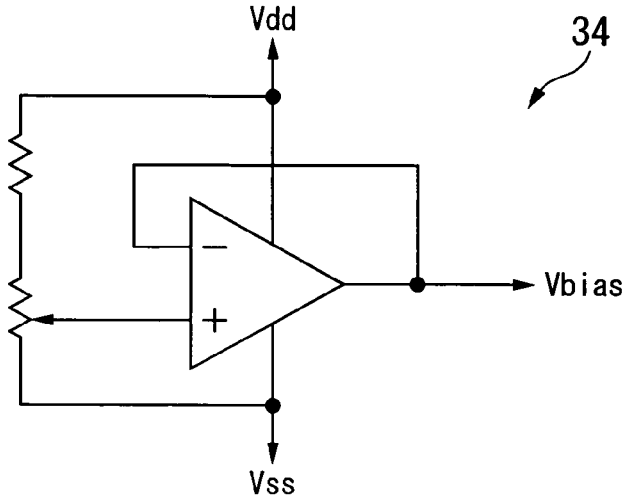

That is, by connecting one three-state buffer circuit 33 to each pixel electrode 14, the pixel electrode side circuit 32 applies a ground electric potential Vss (0V) to each pixel electrode 14 or applies a voltage Vdd of 15 V to each pixel electrode 14. On the other hand, by connecting a bias voltage setting circuit 34 to the common electrode 13 through the three-state buffer circuit 33, the common electrode side circuit 31 applies a bias voltage (Vbias) set in the bias voltage setting circuit 34 to the common electrode or applies the voltage Vdd of 15 V to the common electrode 13. For example, the bias voltage setting circuit 34 is constructed by combining a variable resistor and an operational amplifier (voltage follower), as shown in FIG. 4B.

Here, the TFT 16 functioning as the switching element as shown in FIG. 1 is connected to each pixel circuit 14, and the wiring lines are also connected to each pixel circuit. Therefore, when the ground electric potential Vss (0 V) is applied to each pixel electrode 14, the pixel electrode 14 is affected by a voltage drop due to channel resistance or wiring resistance and wiring capacitance. Therefore, the electric potential of the pixel electrode 14 becomes Vss', not Vss (0 V), even when applying the ground electric potential (0 V) so as to become Vss. The Vss' is a little larger than the Vss, and in the present embodiment, the Vss' is 0.5 V.

In this case, there is not a problem at the time when deleting an image. However, at the time of when writing a new image, on the side of the pixel electrode 14 which forms the background, the electric potential difference occurs between the electric potential (Vss) of the common electrode 13 and the electric potential (Vss') of the pixel electrode 14, so that contrast and image quality deteriorate.

Therefore, in the present invention, when the new image is written, the bias voltage (Vbias) previously set by the bias voltage setting circuit 34 is applied to the pixel electrodes 14 forming the background, not to a portion (the pixel electrodes 14 relevant to the display) forming the substantial display, instead of applying the ground electric potential (0 V) as in the related art.

Figure 5A:
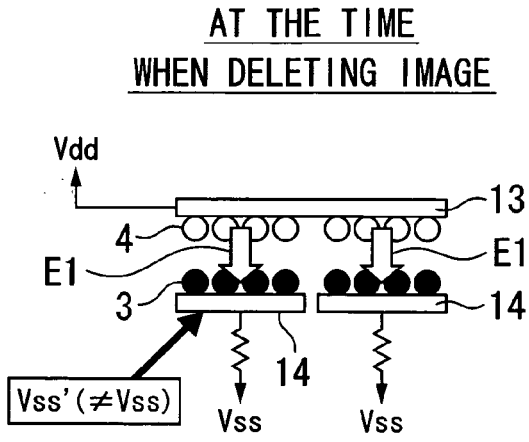
FIGS. 5A and 5B are schematic views for illustrating a driving method of the present invention.
Figure 5B:
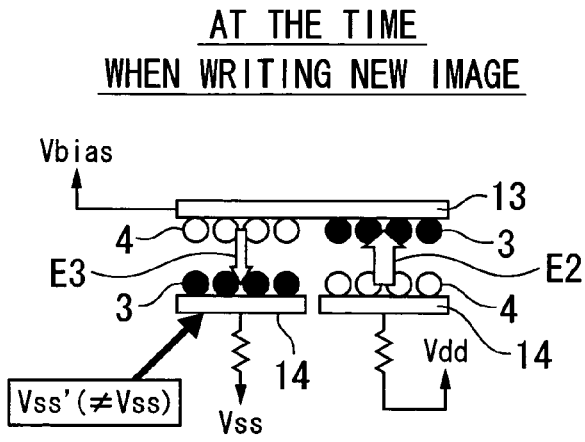
Figure 13B:
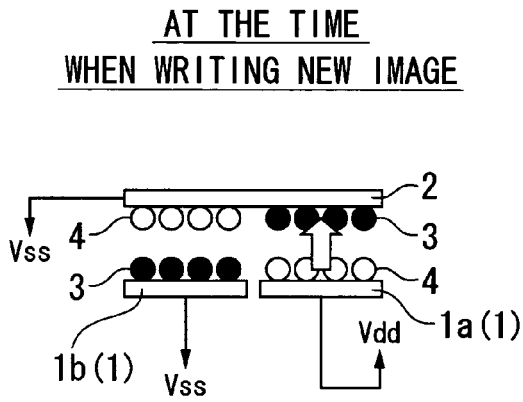
Figure 14A:
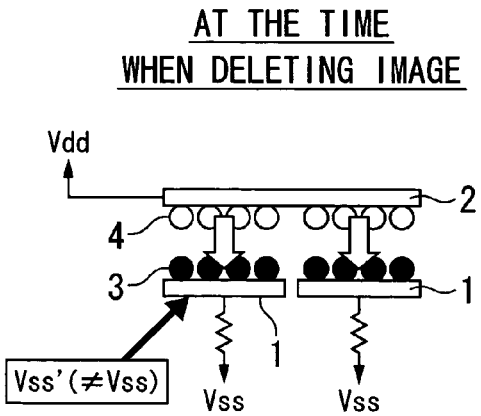
FIGS. 14A and 14B are diagrams for illustrating a problem of the conventional electrophoresis device.
Figure 14B:
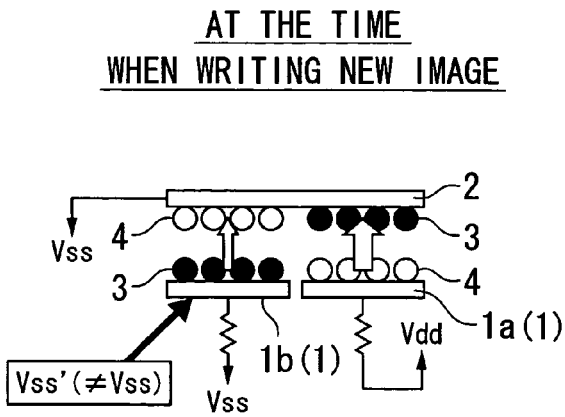

In other words, when the driving circuit 30 changes image to be displayed on the side of the counter substrate 12 (the side of the common electrode 13) by the movement (migration) of the electrophoresis particles 3 and 4 in the microcapsule 15, the displayed image is first deleted over the entire display region, and then a new display image is written on the display region, similar to the conventional art. A driving method by the driving circuit 30 will be schematically described with reference to FIGS. 5A and 5B. In FIGS. 5A and 5B, the description of the microcapsules is omitted in order to simplify the description of FIGS. 5A and 5B by corresponding to FIGS. 13 and 14.

First, as shown in FIG. 5A, all the pixel electrodes 14 are set to have a first electric potential (Vss'), and the common electrode 13 is set to have a second electric potential (Vdd=15 V). In this way, a first electric field E1 is generated between the pixel electrode 14 and the common electrode 13, and the image displayed by that time is deleted over the entire display region. In other words, by the first electric field E1, the white particles (electrophoresis particles) 4 which are charged with the negative polarity move (migrate) toward the common electrode 13, and the black particles (electrophoresis particles) 3 which are charged with the positive polarity move (migrate) toward the pixel electrode 14. As a result, the common electrode 13 functioning as the display surface forms the background color by the white particles 4, so that the previously displayed image is deleted. At this time, the direction of the first electric field E1 is a direction from the common electrode 13 toward the pixel electrode 14, and the intensity of the first electric field E1 is a value obtained by dividing the electric potential difference between the common electrode and the pixel electrode (in this case, 15 V) by the distance between the common electrode and the pixel electrode.

Here, the display region means a region interposed between the pixel electrodes 14 (also, including a region between the pixel regions 14) and the common electrode 13. In addition, setting the first electric potential (Vss') to have all the pixel electrodes 14 actually means to apply the ground electric potential Vss (0 V) to each pixel electrode 14, as in the conventional art. By applying the ground electric potential (0 V) to each electrode, the electric potential of each pixel electrode 14 (first electric potential) becomes Vss' by the influence of wiring capacitance, a voltage drop, etc.

In addition, it is considered that the first electric field (Vss') is a little changed between the pixel electrodes 14. In this case, the maximum value rather than the average value of the pixel electrodes 14 is defined as the first electric potential (Vss') in the present invention. In other words, the maximum value of the first electric potential (Vss') that is determined by the influence of the wiring capacity or the voltage drop becomes 0.5 V.

After that, new display image is rewritten as shown in FIG. 5B (writing a new image).

In other words, the voltage is selectively applied to the pixel electrode 14 corresponding to display to change the electric potential into a fourth electric potential (i.e., Vdd), and a different electric potential is applied to the common electrode 13 to change the electric potential into the third electric potential (Vbias). In this way, a second electric field E2 is generated between the common electrode 13 and the pixel electrode 14 corresponding to display.

At the same time, a fifth electric potential (i.e., Vss') is applied to the pixel electrode 14 not corresponding to display. In this way, a third electric field E3 is generated between the common electrode 13 and the pixel electrode 14 not corresponding to display.

Here, the third electric potential (Vbias) is previously set within a range satisfying all the following conditions.

- the direction of the first electric field E1 is opposite to that of the second electric field E2.
- the direction of the first electric field E1 is the same as that of the third electric field E3.
- the intensity of the second electric field E2 is greater than that of the third electric field E3.

In the present embodiment, since the first electric potential (Vss') is 0.5 V as described above, the third electric potential (Vbias) is regarded as 1 V.

As described above, since the direction of the first electric field E1 is the same as that of the third electric field E3, the electric field from the pixel electrode 14 toward the common electrode 13 as in the conventional art is not generated at the side of the pixel electrode 14 that does not correspond to display and forms the background as it is. As shown in FIG. 5B, the weak electric field (third electric field E3) from the common electrode 13 toward the pixel electrode 14 is generated at the side of the pixel electrode 14.

Therefore, the present invention can solve problems in that the particles 3 and 4 move a little from a location at the time when deleting the image, and in that the gray color is displayed at the portions on which the white color functioning as the background color must be originally displayed, thereby deteriorating contrast and image quality.

In addition, since the direction of the first electric field E1 is opposite to that of the second electric field E2, from the pixel electrode 14 corresponding to display when new display image is written, each particle moves to the electrode side on which each particle is provided in design, and a desired display is made, similar to the conventional art.

In addition, the intensity of the second electric field E2 (a value obtained by dividing the difference between the fourth electric potential (Vdd) and the third electric potential (Vbias) by the distance between the electrodes) is larger than that of the third electric field E3 (a value obtained by dividing the difference between the third electric potential (Vbias) and the fifth electric potential (Vss') by the distance between the electrodes). Therefore, when a change from an image deleting mode to a new image writing mode is made, display switching can be relatively rapidly performed. In other words, a display switching speed by the movement of the electrophoresis particles 3 and 4 depends on the intensity of the second electric field E2 as described above. Therefore, since the intensity of the second electric field E2 is greater than that of the third electric field E3 at the side where the display switching is not performed, the display switching can be relatively rapidly performed.

Here, in order to perform the display switching more rapidly to improve display characteristics, the intensity of the second electric field E2 may be greater than that of the third electric field E3. Specifically, it is preferable that the relationship between the second electric field E2 and the third electric field E3 satisfy the following Formula 1:

$$\text{Intensity of third electric field } E3 \leqq (\text{intensity of second electric field } E2)/10. \quad \text{[Formula 1]}$$

According to the above-mentioned formula, the intensity of the second electric field E2 is greater than that of the third electric field E3 by ten times or more. Therefore, when a change from the image deleting mode to the new image writing mode is made, the display switching can be relatively rapidly performed, so that the display characteristics can be improved. According to the present embodiment, since the fifth electric field (Vss') is set to have 0.5 V, the fourth electric field (Vdd) is set to have 15 V, and the third electric field (Vbias) is set to have 1 V as described above, the above-mentioned conditions are satisfied, so that the display characteristics can be sufficiently improved.

In addition, according to the present embodiment, all electric potentials (i.e., Vbias, Vss', and Vdd) have positive polarities. However, when all the electric potentials (i.e., Vbias, Vss', and Vdd) have the negative polarities, the charged polarity of each particle is reverse to that in the examples shown in FIGS. 5A and 5B, so that the same effect as the case in which all the electric potential have the positive polarities is obtained.

In the electrophoresis device 10 according to the present embodiment, when a new display image is written, the electric potential of the common electrode 13 is set to the third electric potential (Vbias), not the electric potential (Vss) as in the conventional art. Therefore, it is possible to prevent the deterioration of contrast and image quality caused by the electric field from the pixel electrode 14 toward the common electrode 13.

In addition, since the intensity of the second electric field E2 is greater than that of the third electric field E3, display switching can be relatively rapidly performed when a change from the image deleting mode to the new image writing mode is made.

In addition, in the method of driving the electrophoresis device of the present invention, the same effects as those in the above-mentioned electrophoresis device can be obtained.

Second Embodiment

Next, an electrophoresis device according to a second embodiment of present invention will be described.

The second embodiment of the present invention is mainly different from the first embodiment in that electrodes arranged in a dot shape are used as the pixel electrodes instead of using the segment electrodes corresponding to display image, and that the electrodes are driven in an active matrix manner.

Figure 6:
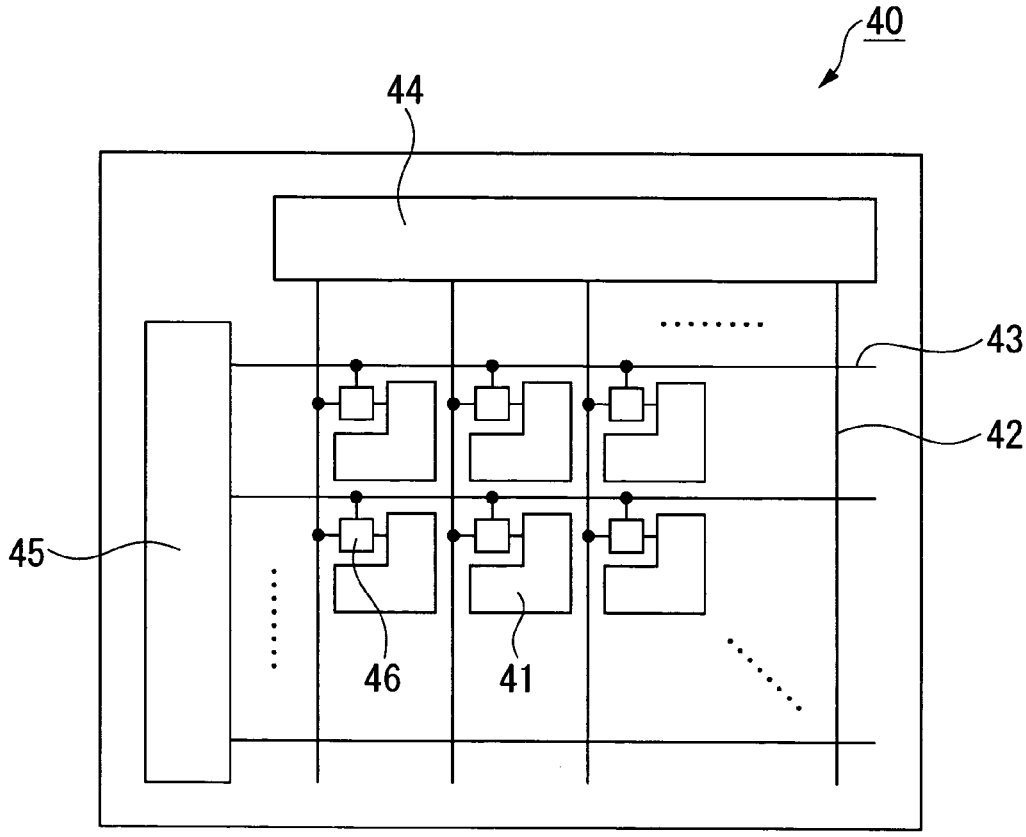
FIG. 6 is a plan view of an electrophoresis device according to a second embodiment of the present invention.

FIG. 6 is a diagram showing an electrophoresis device according to a second embodiment of the present invention. In FIG. 6, reference numeral 40 indicates the electrophoresis device. The electrophoresis device 40 has a microcapsule layer 15*a* composed of the microcapsules 15 interposed between a substrate (not shown) including a plurality of pixel electrodes 41 and a substrate (not shown) including a common electrode.

On one substrate on which the pixel electrodes 41 are formed, a plurality of data lines 42, a plurality of scanning lines 43 intersecting the plurality of data lines 42, a data line control circuit 44 for supplying data signals to the plurality of data lines 42, and a scanning line control circuit 45 for supplying scanning signals to the plurality of scanning lines 43 are formed. In addition, switching elements 46 composed of TFTs are respectively connected to the data lines 42 and the scanning lines 43 in the vicinities of intersecting portions therebetween, and the pixel electrodes 41 are connected to the data lines 42 and the scanning lines 43 through the switching elements 46. The pixel electrodes 41 are arranged in a matrix according to the above-mentioned structure. Here, the data line control circuit 44 and the scanning line control circuit 45 constitute the pixel electrode side circuit 32 of the first embodiment.

In the other substrate, the common electrode is arranged on the entire display region, that is, the entire region opposite to the region on which the pixel electrodes 41 are formed as described above. The common electrode side circuit 31 (not shown in FIG. 6) according to the first embodiment is connected to the common electrode. In addition, the pixel electrode side circuit 32 composed of the data line control circuit 44 and the scanning line control circuit 45 and the common electrode side circuit 31 constitute the driving circuit 30 (not shown in FIG. 6) according to the present invention.

In addition, similar to the first embodiment, the driving circuit 30 drives the electrophoresis device 40 according to the second embodiment.

In other words, when the image displayed on the common electrode side is changed by the movement (migration) of the electrophoresis particles 3 and 4 in the microcapsule 15, the driving circuit 30 deletes the image displayed over the entire display region and then writes new display image on the display region.

In order to delete the displayed image over the entire display region, first, a predetermined voltage is applied to the common electrode to set the common electrode to have the second electric potential (Vdd; for example, 15 V). In addition, the Vss (for example, 0 V) is sequentially supplied from the data line control circuit 44 to all the data lines 42. In addition, one of the scanning lines 43 is selected by the scanning line control circuit 45, and the switching element 46 connected to the selected scanning line 43 is turned on. In addition, by repeating this process, the voltage of the data lines 42 is supplied to all the pixel electrodes 41 to make all the pixel electrodes 41 have the first electric potential. Similar to the first embodiment, the voltage drop occurs in the pixel electrodes 41 because of the wiring resistance or wiring capacitance of the data lines 42 and the channel resistance of the switching elements 46. Therefore, the electric potential of the pixel electrode 41 (first electric potential) becomes Vss' (for example, 0.5 V).

In this manner, the first electric field E1 is generated between the pixel electrode 41 and the common electrode, and the image displayed by that time is deleted over the entire display region. In other words, by the first electric field E1, the white particles (electrophoresis particles) which are charged with the negative polarity move (migrate) toward the common electrode side, and the black particles (electrophoresis particles) which are charged with the positive electrode move (migrate) toward the pixel electrode 41. As a result, the common electrode side functioning as the display surface forms the background color by the white particles, so that the previously displayed image is deleted, similar to the first embodiment. At this time, the direction of the first electric field E1 is a direction from the common electrode toward the pixel electrode 41, and the intensity of the first electric field E1 is a value obtained by dividing the electric potential difference between the common electrode and the pixel electrode (in this case, 15 V) by the distance between the common electrode and the pixel electrode.

Then, in order to write new display image, first, a different voltage is applied to the common electrode, so that the electric potential of the common electrode is changed to the third electric potential (Vbias). In addition, the voltage is selectively applied to the pixel electrodes 41 corresponding to display by the pixel electrode side circuit 32 composed of the data line control circuit 44 and the scanning line control circuit 45, so that the electric potentials of the pixel electrodes 41 are sequentially changed to the fourth electric potential (i.e., Vdd). In addition, a voltage (Vss') equal to the voltage before the image is rewritten as the fifth electric potential is sequentially applied to the pixel electrodes 41 which do not correspond to display and form the background as it is. As a result, the second electric field E2 is generated between the common electrode and the pixel electrodes 41 corresponding to display, and the third electric field E3 is generated between the common electrode and the pixel electrodes 41 not corresponding to display.

Here, the third electric potential (Vbias) is previously set within a range satisfying all the above-mentioned conditions, similar to the first embodiment. According to the present embodiment, the third electric potential is, for example, 1 V.

In this way, in the pixel electrode which does not correspond to display and forms the background as it is, the electric field from the pixel electrode 41 toward the common electrode is not generated as in the conventional art, and a weak electric field (i.e., third electric field E3) from the common electrode toward the pixel electrode 41 is generated.

Therefore, the present invention can solve problems in that the particles 3 and 4 move a little from the locations at the time when deleting an image, and in that the gray color is displayed at the portions on which the white color functioning as the background color must be originally displayed, thereby deteriorating contrast and image quality.

In addition, after the writing of new image on the screen is completed, all the scanning lines 43 become a non-selected state, so that it is possible to hold their display states.

Also, in the electrophoresis device 40 according to the present embodiment, when the new display image is written, the electric potential of the common electrode is set to the third electric potential (Vbias), not the electric potential (Vss) as in the conventional art. Therefore, it is possible to prevent the deterioration of contrast and image quality caused by the electric field from the pixel electrode 41 toward the common electrode.

In addition, since the intensity of the second electric field E2 is greater than that of the third electric field E3, the display switching can be relatively rapidly performed when a change from an image deleting mode to a new image writing mode is made.

In addition, in the method of driving the electrophoresis device, the same effects as those in the electrophoresis device can be obtained.

Third Embodiment

Next, an electrophoresis device according to a third embodiment of the present invention will be described.

The third embodiment of the present invention is mainly different from the second embodiment in that the electrophoresis device according to the third embodiment is an in-plane type.

Figure 7A:
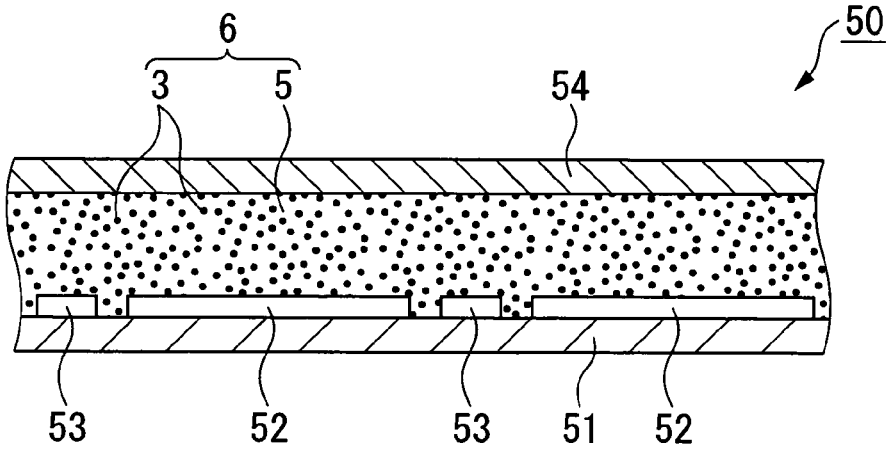
FIGS. 7A and 7B are diagrams of an electrophoresis device according to a third embodiment of the present invention.
Figure 7B:
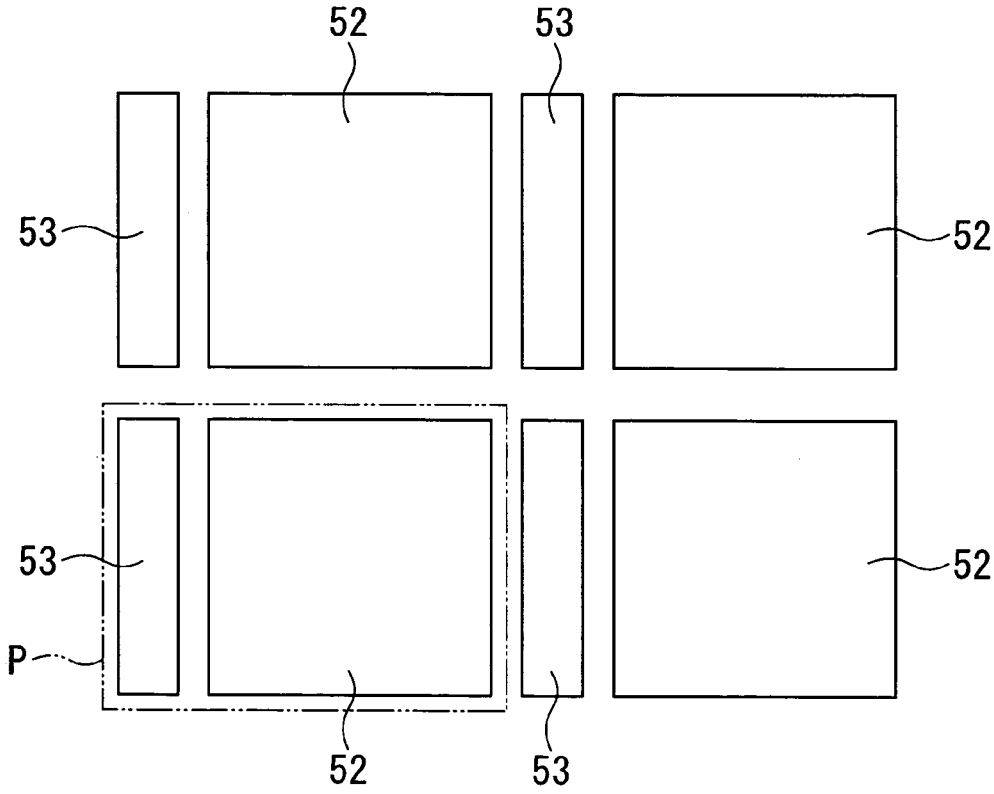

FIGS. 7A and 7B are diagrams showing the electrophoresis device according to the third embodiment of the present invention. In FIGS. 7A and 7B, reference numeral 50 indicates an electrophoresis device. The electrophoresis device 50 is an in-plane type, and a plurality of pixel electrodes 52 and a plurality of common electrodes 53 are formed on one substrate 51 as shown in a side cross-sectional view of FIG. 7A. In addition, the other substrate 54 is provided above the pixel electrodes 52 and the common electrodes 53. An electrophoresis dispersion media (liquid material) 6 composed of electrophoresis particles (black particles) 3 and a liquid dispersant 5 for dispersing the electrophoresis particles 3 described in the above-mentioned embodiments is sealed between the substrate 54 and the pixel electrodes 52 and the common electrodes 53 on the substrate 51. However, according to the third embodiment, the electrophoresis particles (black particles) 3 are charged with the negative polarity, not the positive polarity.

The pixel electrodes 52 and the common electrodes 53 are arranged so as to be adjacent to each other as shown in a plan view of essential parts of FIG. 7B, and a set of the pixel electrode 52 and the common electrode 53 adjacent to each other constitute a unit pixel P. In addition, an area ratio (width ratio) of the pixel electrode 52 to the common electrode 53 is, for example, 20:1, so that the pixel electrode 52 has a width much larger than that of the common electrode 53. Therefore, a display region mainly formed of the pixel electrodes 52 is constructed so as not to be small due to the common electrodes 53. In FIGS. 7A and 7B, the area ratio (a width ratio) of the pixel electrode 52 to the common electrode 53 is shown smaller than an actual area ratio, for the sake of convenience.

The driving circuit 30 (not shown in FIGS. 7A and 7B) that is described in the above-mentioned second embodiment is formed on the substrate 51 having the pixel electrodes 52 and the common electrodes 53 thereon. In other words, the pixel electrode side circuit 32 is connected to each pixel electrode 52, and the common electrode side circuit 31 is connected to each common electrode 53.

In addition, the driving circuit 30 drives the electrophoresis device 50 according to the third embodiment in the same manner as the first and second embodiments.

In other words, when displayed image is changed by the movement (migration) of the electrophoresis particles 3, first, the driving circuit 30 deletes the displayed image over the entire display region and then writes new display image.

Figure 8A:
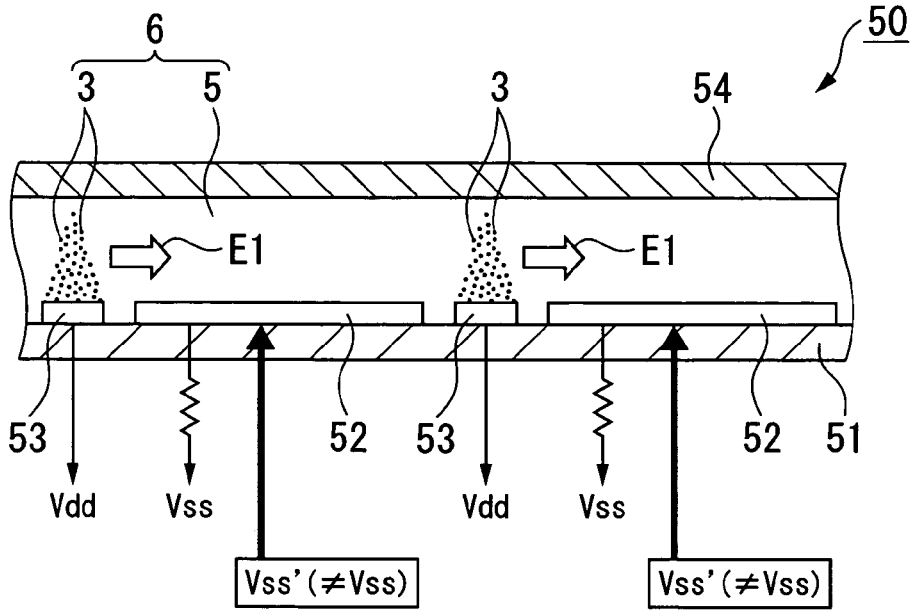
FIGS. 8A and 8B are diagrams for illustrating a method of driving the electrophoresis device according to the third embodiment of the present invention.

In order to delete the displayed image over the entire display region, first, a predetermined voltage is applied to each common electrode 53 to make all the common electrodes 53 have the second electric potential (Vdd; 15 V), as shown in FIG. 8A. In addition, a common voltage is applied to all the pixel electrodes 52 to make all the pixel electrodes 52 have the first electric potential (Vss'; 0.5 V). Then, the first electric field E1 from the common electrode 53 toward the pixel electrode 52 is generated between the pixel electrode 52 and the common electrode 53 adjacent to each other, so that the image displayed by that time is deleted over the entire display region.

In other words, by the first electric field E1, the black particles (electrophoresis particles) 3 which are charged with the negative polarity move (migrate) toward the common electrode 53, so that the black particles (electrophoresis particles) 3 do not exist in the pixel electrode 52. Then, since the area of the common electrode 53 is sufficiently smaller than that of the pixel electrode 52 as described above, the black particles (electrophoresis particles) 3 existing in the common electrodes 53 cannot be almost seen. As a result, only the background color by the pixel electrodes 52 can be seen without substantial display, so that the previously displayed image is deleted.

Figure 8B:
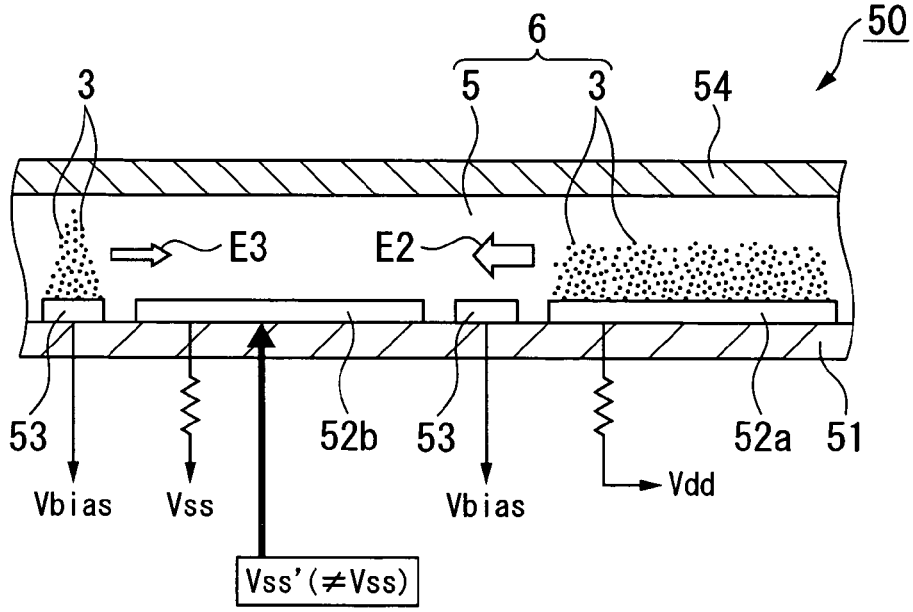

Then, in order to write new display image, first, a different voltage is applied to the common electrodes 53 to change the electric potentials of the common electrodes 53 into the third electric potential (Vbias), as shown in FIG. 8B. In addition, the voltage is selectively applied to the pixel electrodes 52*a* corresponding to display, so that the electric potentials of the pixel electrodes are changed to the fourth electric potential (for example, Vdd). In addition, a voltage (Vss') equal to the voltage before the image is rewritten, serving as the fifth electric potential, is applied to the pixel electrodes 52*b* forming the background as it is without corresponding to display. As a result, the second electric field E2 is generated between the common electrodes 53 and the pixel electrodes 52*a* corresponding to display, and the third electric field E3 is generated between the common electrodes 53 and the pixel electrodes 52*b* not corresponding to display.

Here, the third electric potential (Vbias) is previously set within a range satisfying all the above-mentioned conditions, similar to the above-mentioned embodiments. According to the present embodiment, the third electric potential is, for example, 1 V.

In this way, in the pixel electrodes 52*b* forming the background as they are without corresponding to display, an electric field from the pixel electrode 52*b* toward the common electrode 53 is not generated, and a weak electric field (i.e., third electric field E3) from the common electrode 53 toward the pixel electrode 52*b* is generated.

Therefore, the present invention can solve a problem in that the black particles (electrophoresis particles) 3 move a little from the locations at the time when deleting an image to the pixel electrode 52*b*, so that the black particles 3 appear to be a stripe shape, thereby deteriorating image quality.

In the electrophoresis device 50 according to the present embodiment, when the new display image is written, the electric potential of the common electrode is set to the third electric potential (Vbias), not the electric potential (Vss) as in the conventional art. Therefore, it is possible to prevent the deterioration of contrast and image quality caused by the electric field from the pixel electrode 52 toward the common electrode 53.

In addition, since the intensity of the second electric field E2 is greater than that of the third electric field E3, display switching can be relatively rapidly performed when a change from an image deleting mode to a new image writing mode is made.

In addition, in the method of driving the electrophoresis device, the same effects as those in the above-mentioned electrophoresis device can be obtained.

In addition, the present invention is not limited to the above-mentioned embodiments, and various changes can be made without departing from the spirit of the present invention. For example, both the pair of substrates may be composed of a hard substrate instead of one or all of the substrates being composed of a flexible substrate.

In addition, although the case in which one display region is provided is described in the above-mentioned embodiments, the present invention can be applied to the case in which a plurality of display regions is separately formed in an island shape.

Next, an electronic apparatus of the present invention will be described. The electronic apparatus of the present invention includes the above-mentioned electrophoresis device according to the present invention.

Hereinafter, examples of the electronic apparatus including the electrophoresis device will be described.

<Mobile Computer>

Figure 9:
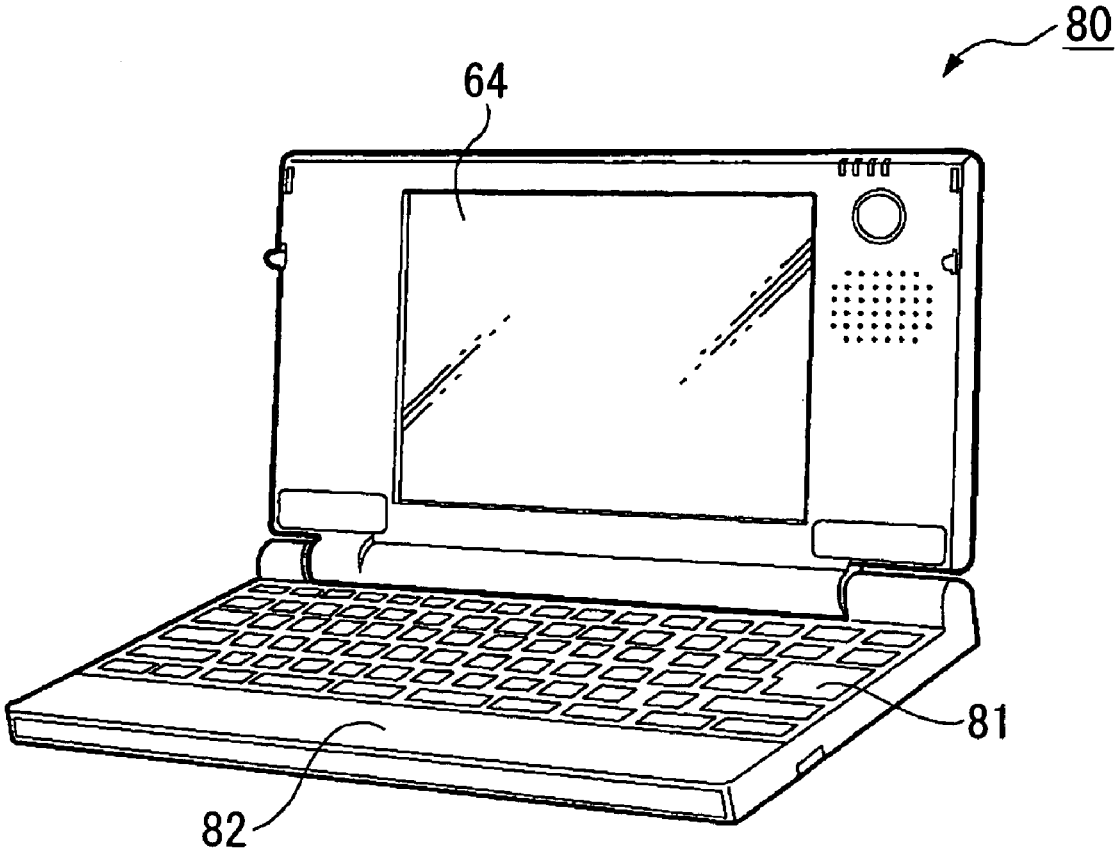
FIG. 9 is a perspective view showing an external structure of a computer, which is an example of an electronic apparatus according to the present invention.

First, an example in which the electrophoresis device is applied to a mobile type of personal computer will be described. FIG. 9 is a perspective view showing a structure of the personal computer. As shown in FIG. 9, a personal computer 80 includes a main body 82 having a keyboard 81 and a display unit having the electrophoresis device 64.

<Mobile Phone>

Figure 10:
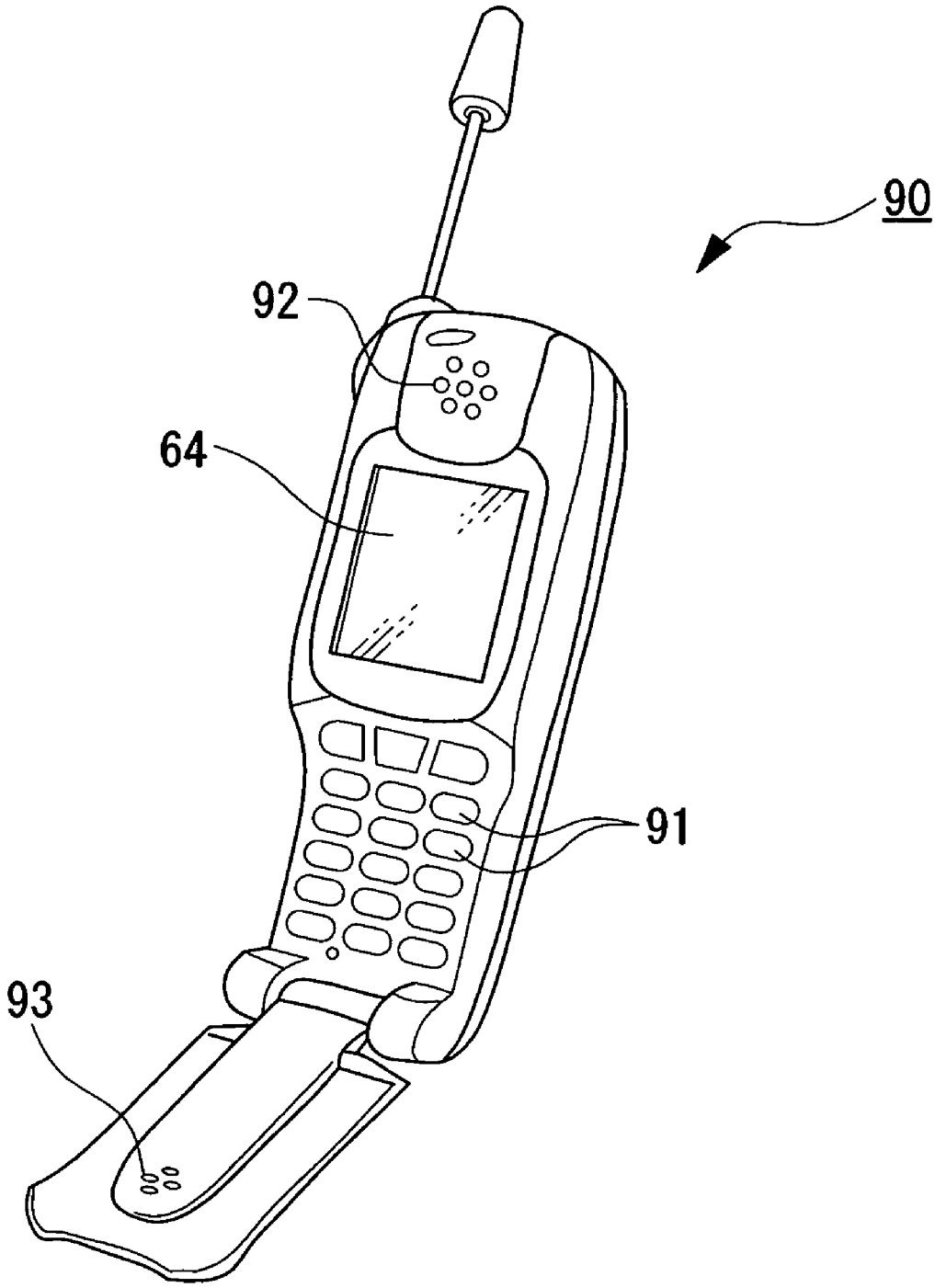
FIG. 10 is a perspective view showing an external structure of a mobile phone, which is an example of the electronic apparatus according to the present invention.

Next, an example in which the electrophoresis device is applied to a display unit of the mobile phone will be described. FIG. 10 is a perspective view showing a structure of the mobile phone. As shown in FIG. 10, a mobile phone 90 includes a plurality of operation buttons 91, an earpiece 92, a mouthpiece 93, and the electrophoresis device 64.

<Electronic Paper>

Figure 11:
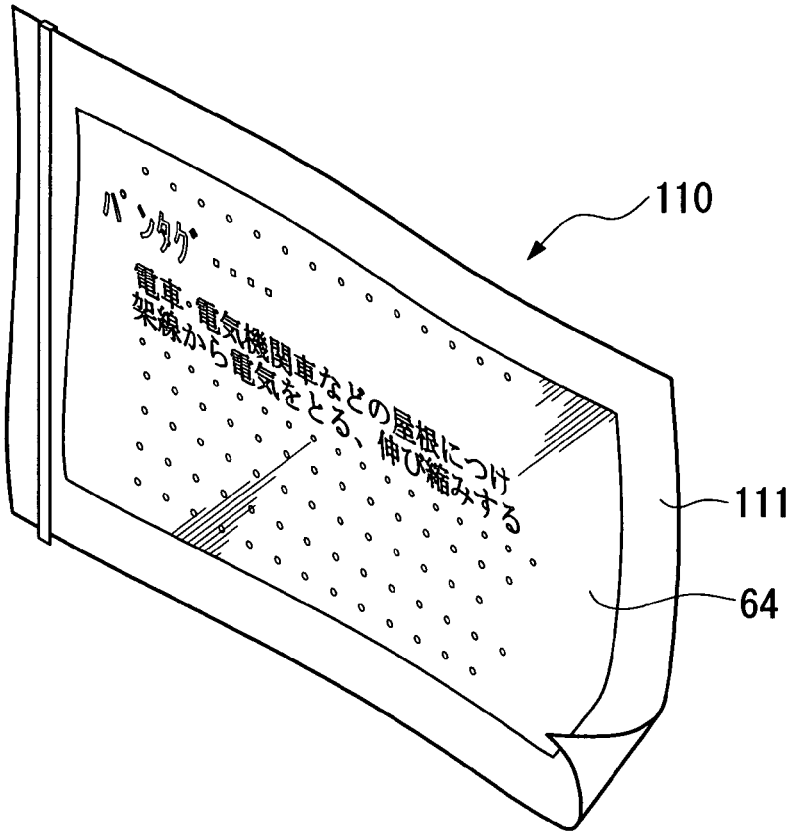
FIG. 11 is a perspective view showing an external structure of an electronic paper, which is an example of the electronic apparatus according to the present invention.

Next, an example in which the electrophoresis device is applied to a display unit of an electronic paper will be described. FIG. 11 is a perspective view showing a structure of the electronic paper. An electronic paper 110 includes a main body 111 composed of a rewritable sheet having the same texture or flexibility as paper and a display unit having the electrophoresis device 64.

<Electronic Note>

Figure 12:
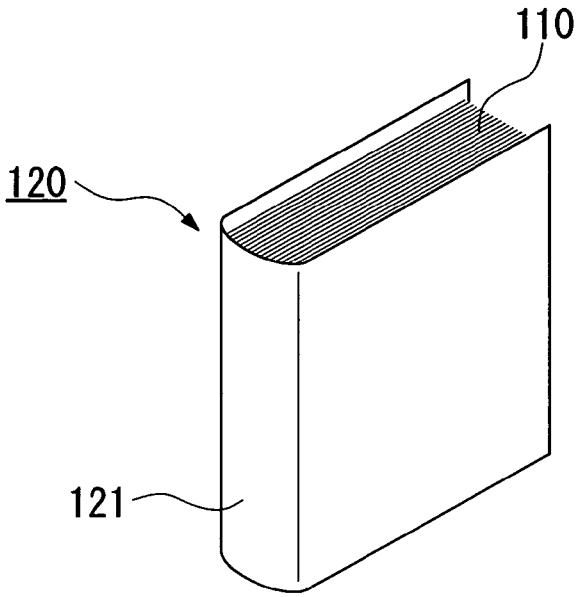
FIG. 12 is a perspective view showing an external structure of an electronic note, which is an example of the electronic apparatus according to the present invention.

FIG. 12 is a perspective view showing a structure of an electronic note. As shown in FIG. 12, an electronic note 120 is obtained by binding a plurality of sheets of the electronic papers 110 shown in FIG. 11 and by inserting the electronic papers 110 into a cover 121. The cover 121 has display data input means, so that image displayed on the electronic papers can be changed in a state in which the plurality of sheets of the electronic papers is bound.

According to these electronic apparatuses, it is possible to prevent the deterioration of image quality. In addition, since each electronic apparatus has the electrophoresis device in which display switching can be relatively rapidly performed when a new image is written, a display unit using the electrophoresis device that is included in each electronic apparatus can have high reliability.

In addition, the electronic apparatus may be an IC card including the electrophoresis device as a display unit and a fingerprint recognizing sensor, an electronic book, a viewfinder-type and monitor-direct-view-type video tape recorder, a car navigation device, a pager, an electronic organizer, a calculator, a word processor, a work station, a video phone, a POS terminal, an apparatus including a touch panel as well as the personal computer illustrated in FIG. 9, the mobile phone illustrated in FIG. 10, the electronic paper illustrated in FIG. 11, and the electronic note illustrated in FIG. 12. In addition, the electrophoresis device can be used as the display units of these various electronic apparatuses.

What is claimed is:

1. An electrophoresis device comprising:

a pair of substrates;

a plurality of pixel electrodes and a common electrode respectively formed on the pair of substrates;

a liquid material obtained by dispersing charged particles sealed between the pair of substrates; and a driving circuit for applying a voltage to the pixel electrodes and the common electrode to generate an electric field therebetween, the electrophoresis device performing display by moving the charged particles through the electric field generated by applying the voltage, wherein the driving circuit is adapted to cause all of the pixel electrodes to have a first electric potential cause the common electrode to have a second electric potential, and thereby generate a first electric field between all the pixel electrodes and the common electrode to delete current image displayed over an entire display region when a display image is changed, the driving circuit is adapted to cause the electric potential of the common electrode to change to a third electric potential, cause the electric potentials of the pixel electrodes corresponding to the display to change to a fourth electric potential, cause the electric potentials of the pixel electrodes not corresponding to the display to change to a fifth electric potential, and thereby generate a second electric field between the common electrode and the pixel electrodes corresponding to display and generate a third electric field between the common electrode and the pixel electrodes not corresponding to the display when new display image is to be depicted, the direction of the first electric field is opposite to that of the second electric field, the direction of the first electric field is the same as that of the third electric field, the intensity of the second electric field is greater than that of the third electric field, and the third electric potential is defined according to a maximum voltage shift of electric potential which occurs among the pixel electrodes when the first electric potential is applied to the pixel electrodes.

2. The electrophoresis device according to claim 1, wherein the relationship between the second electric field and the third electric field satisfies the following Formula 1:

$$\text{the intensity of the third electric field} \leqq (\text{the intensity of the second electric field})/10 \quad \text{[Formula 1]}.$$

3. The electrophoresis device according to claim 1, wherein the intensity of the third electric field is substantially zero.

4. The electrophoresis device according to claim 1, wherein the liquid material in which the charged particles are dispersed is filled into a microcapsule.

5. The electrophoresis device according to claim 1, wherein the charged particles are composed of a first electrophoresis particle charged with a first polarity and having a first color and a second electrophoresis particle charged with a second polarity and having a second color.

6. The electrophoresis device according to claim 1, wherein the pair of substrates are composed of flexible substrates.

7. An electronic apparatus having the electrophoresis device according to claim 1.

8. A method of driving an electrophoresis device comprising a pair of substrates, a plurality of pixel electrodes and a common electrode formed on the pair of substrates, a liquid material obtained by dispersing charged particles sealed between the pair of substrates, and a driving circuit for applying a voltage to the pixel electrodes and the common electrode to generate an electric field therebetween, the electrophoresis device performing display by moving the charged particles through the electric field generated by applying the voltage, the method comprising:

generating, when a display image is changed, a first electric field between all the pixel electrodes and the common electrode to delete current image displayed over an entire display region by causing all of the pixel electrodes to have a first electric potential, and causing the common electrode to have a second electric potential; and generating a second electric field between the common electrode and the pixel electrodes corresponding to display and a third electric field between the common electrode and the pixel electrodes not corresponding to the display when new display image is written, by causing the electric potential of the common electrode to change to a third electric potential, causing the electric potentials of the pixel electrodes corresponding to the display to change to a fourth electric potential and causing the electric potentials of the pixel electrodes not corresponding to the display to change to a fifth electric potential;

wherein the direction of the first electric field is opposite to that of the second electric field, the direction of the first electric field is the same as that of the third electric field, the intensity of the second electric field is greater than that of the third electric field and the third electric potential is defined according to a maximum voltage shift of electric potential which occurs among the pixel electrodes when the first electric potential is applied to the pixel electrodes.

* * * * *

UNITED STATES PATENT AND TRADEMARK OFFICE

CERTIFICATE OF CORRECTION

PATENT NO. : 7,612,760 B2
APPLICATION NO. : 11/319394
DATED : November 3, 2009
INVENTOR(S) : Hideyuki Kawai It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 944 days.

Signed and Sealed this

Nineteenth Day of October, 2010

David J. Kappos

David J. Kappos
*Director of the United States Patent and Trademark Office*